US011456097B2

(12) United States Patent
Ariake et al.

(10) Patent No.: US 11,456,097 B2
(45) Date of Patent: Sep. 27, 2022

(54) COMPOSITE MAGNETIC BODY

(71) Applicant: TDK Corporation, Tokyo (JP)

(72) Inventors: Yusuke Ariake, Tokyo (JP); Isao Kanada, Tokyo (JP)

(73) Assignee: TDK Corporation, Tokyo (JP)

( * ) Notice: Subject to any disclaimer, the term of this patent is extended or adjusted under 35 U.S.C. 154(b) by 873 days.

(21) Appl. No.: 16/295,074

(22) Filed: Mar. 7, 2019

(65) Prior Publication Data

US 2019/0304644 A1 Oct. 3, 2019

(30) Foreign Application Priority Data

Mar. 28, 2018 (JP) ..... JP2018-062531

(51) Int. Cl.

| | |
|---|---|
| ***H01F 1/147*** | (2006.01) |
| ***H01F 1/34*** | (2006.01) |
| ***H01F 1/24*** | (2006.01) |
| ***H01F 1/28*** | (2006.01) |

(52) U.S. Cl.
CPC ..... *H01F 1/147* (2013.01); *H01F 1/24* (2013.01); *H01F 1/28* (2013.01); *H01F 1/342* (2013.01)

(58) Field of Classification Search
CPC ..... H01F 1/24; H01F 1/28
See application file for complete search history.

(56) References Cited

U.S. PATENT DOCUMENTS

| | | | | |
|---|---|---|---|---|
| 4,773,931 | A * | 9/1988 | Mishima ..... | G11B 5/70615 420/87 |
| 5,207,841 | A | 5/1993 | Shigeta et al. | |
| 6,391,450 | B1 * | 5/2002 | Okinaka ..... | C01G 49/06 420/83 |
| 2014/0158929 | A1 | 6/2014 | Oikawa et al. | |
| 2019/0210104 | A1 | 7/2019 | Yamaji et al. | |

FOREIGN PATENT DOCUMENTS

| | | | |
|---|---|---|---|
| JP | H04-012502 | A | 1/1992 |
| JP | 2010-238748 | A | 10/2010 |
| JP | 2012-134463 | A | 7/2012 |
| JP | 2013-247351 | A | 12/2013 |
| JP | 2014-116332 | A | 6/2014 |

* cited by examiner

*Primary Examiner* — C Melissa Koslow
(74) *Attorney, Agent, or Firm* — Faegre Drinker Biddle & Reath LLP

(57) ABSTRACT

The present invention provides a composite magnetic body comprising metal particles containing Fe or Fe and Co as a main component and a resin, wherein an average major axis diameter of the metal particles is 30 to 500 nm, an average of the aspect ratios of the metal particles is 1.5 to 10, and a CV value of the aspect ratios is 0.40 or less.

2 Claims, No Drawings

COMPOSITE MAGNETIC BODY

TECHNICAL FIELD

The present invention relates to a composite magnetic body.

BACKGROUND

In recent years, frequency bands used in wireless communication devices such as cellular phones and portable information terminals have been increased in frequency, and radio signal frequencies used are in the GHz band such as the 2.4 GHz band used in wireless LAN or the like. In order to improve characteristics of electronic components and miniaturize the dimensions thereof used in such GHz band (high frequency band), such as inductors, EMI filters, and antennas, magnetic materials have been required to have high magnetic permeability and low magnetic loss. The EMI filter is used for high frequency noise countermeasure of electronic equipment, and the antenna is used for wireless communication equipment.

Particularly when a magnetic material is used for the above described electronic component which is required to be miniaturized, it is preferable that the magnetic material is applicable to processes such as screen printing, injection molding, and extrusion which can cope with compact and complicated shapes. In this case, a composite magnetic material prepared by mixing a magnetic powder and a resin is more suitable than a sintered body for a form of the magnetic material.

As a composite magnetic material capable of coping with a high frequency band, a composite magnetic material in which a magnetic oxide containing hexagonal ferrite as a main phase is dispersed in a resin is proposed in Patent Literature 1. A magnetic composite material in which needle-like magnetic metal particles having an aspect ratio (major axis length/minor axis length) of 1.5 to 20 are dispersed in a dielectric material is proposed in Patent Literature 2.

CITATION LIST

Patent Literature

Patent Literature 1: Japanese Unexamined Patent Publication No. 2010-238748

Patent Literature 2: Japanese Unexamined Patent Publication No. 2014-116332

SUMMARY

However, in the composite magnetic material using the magnetic oxide disclosed in Patent Literature 1, although the magnetic loss coefficient tan $\delta_\mu$ is as small as 0.01 at a frequency of 2 GHz, the real part $\mu'$ of the complex permeability becomes as small as 1.4. In addition, with respect to the magnetic composite material using the magnetic metal particles disclosed in Patent Literature 2, the loss tangent tan $\delta_\mu$ is as small as 0.014 at a frequency of 3 GHz when the magnetic permeability $\mu'$ is as small as 1.37, and on the other hand, tan $\delta_\mu$ is as large as 0.096 when $\mu'$ is as large as 1.98. According to the investigations of the inventors of the present invention, the conventional technology cannot satisfy both of the high magnetic permeability and the low magnetic loss at the same time in the high frequency band.

The present invention has been made in view of the above circumstances, and the object thereof is to provide a composite magnetic body having high magnetic permeability and low magnetic loss in a high frequency band, and a high frequency electronic component using the same.

The present invention provides a composite magnetic body comprising metal particles containing Fe or Fe and Co as a main component and a resin, wherein an average value of the major axis diameter of the metal particles is 30 to 500 nm, an average value of the aspect ratios of the metal particles is 1.5 to 10, and a CV value of the aspect ratio is 0.40 or less. The above described composite magnetic body can provide high magnetic permeability and low magnetic loss in a high frequency band.

In the above described composite magnetic body, it is preferable that the metal particle comprises a metal core portion and a metal oxide film coating the metal core portion. The metal particle is provided with the metal oxide film, allowing to provide the insulating property between the metal particles and to reduce magnetic loss caused by eddy current generation.

The present invention also provides a high frequency electronic component comprising the composite magnetic body. The above described high frequency electronic component can cope with high frequency band.

The present invention can provide a composite magnetic body having high magnetic permeability and low magnetic loss in a high frequency band, and a high frequency electronic component using the same.

DETAILED DESCRIPTION

Hereinafter, preferred embodiments of the present invention will be described. However, the present invention is not limited to the following embodiments.

[Composite Magnetic Body]

The composite magnetic body according to the present embodiment is a molded body containing the metal particles and the resin.

(Metal Particles)

The metal particle contains Fe, or Fe and Co as a main component, and preferably contains Fe and Co as a main component. The metal particle contains Fe or Fe and Co having high saturation magnetization as a main component, allowing for the composite magnetic body to have high magnetic permeability. The main component means a component occupying 50 mass % or more. The metal particle preferably further contains at least one nonmagnetic metal element selected from the group consisting of Al, R, Mn, Ti, Zr, Hf, Mg, Ca, Sr, Ba, and Si, and more preferably contains Al or R, and furthermore preferably contains Al and R. R represents a rare earth element or Y, and preferably represents Y. Examples of rare earth elements include La, Ce, Pr, Nd, Sm, Eu, Gd, Tb, Dy, Ho, Er, Tm, Yb, Lu, and Y. In addition to Al and/or R, the metal particle may further contain at least one selected from the group consisting of Mn, Ti, Zr, Hf, Mg, Ca, Sr, Ba, and Si as the above described nonmagnetic metal elements. The metal particle can also be referred to as the metal magnetic particle.

The total mass ratio of Fe and Co in the metal particle (mass ratio of Fe when the metal particle does not contain Co) is preferably 80 mass % or more, more preferably 85 mass % or more, and furthermore preferably 90 mass % or more. The mass ratio of Fe and Co is 80 mass % or more, easily providing high magnetic permeability. The mass ratio of Fe and Co in the metal particle may be 99 mass % or less, and may be 95 mass % or less. The mass ratio of Fe and Co is 99 mass % or less, easily providing low magnetic loss. When the metal particle contains Co, it is preferable that the mass ratio of Co in the metal particle is 1.0 to 30 mass %. When the mass ratio of Co is 30 mass % or less, it is easy to stably control the size and shape of the metal particle. From the same viewpoint, the mass ratio of Co is more preferably 3.0 to 25 mass %, and furthermore preferably 5.0 to 20 mass %. In the present specification, the mass ratio is the mass ratio based on the total mass of elements having an atomic number of 11 (Na) or more. Therefore, for example, oxygen contained in a metal oxide film, which will be described later, is not considered in the measurement and calculation of the mass ratio.

It is preferable that the mass ratio of Al in the metal particle is 0.1 to 5.0 mass %. It is preferable that the mass ratio of R in the metal particle is 0.5 to 10.0 mass %. The mass ratio of Al and/or R is the above lower limit value or more, further strengthening the metal oxide film of the metal particle, allowing to further reduce the magnetic loss, and also improving the reliability of the magnetic characteristics. The mass ratio of Al and/or R is the above described upper limit value or less, allowing to suppress the reduction of the saturation magnetization and to suppress the reduction of the magnetic permeability accompanying this. From the same viewpoint, it is more preferable that the mass ratio of Al is 1.0 to 3.0 mass %. Further, it is more preferable that the mass ratio of R 2.0 to 6.0 mass %.

The mass ratio of at least one nonmagnetic metal element selected from the group consisting of Mn, Ti, Zr, Hf, Mg, Ca, Sr, Ba, and Si in the metal particle can be 0.1 to 1.0 mass %.

In the present embodiment, the metal particles have an average aspect ratio of 1.5 to 10. The average aspect ratio is the average value of the ratios (aspect ratios) of the major axis diameter to the minor axis diameter of the particles. The average aspect ratio of the metal particles is within the above range, allowing to control the natural resonance frequency and to reduce the magnetic loss. That is, the average aspect ratio is 1.5 or more, allowing to increase the difference between the use frequency and the resonance frequency and thereby to reduce the magnetic loss of the composite magnetic body. In addition, the average aspect ratio is 10 or less, allowing to suppress an increase in magnetic loss even in the GHz band while suppressing a decrease in magnetic permeability of the composite magnetic body, and to provide a composite magnetic body applicable to a high frequency band. From the same viewpoint, the average aspect ratio of the metal particles is preferably 1.8 to 8, and more preferably 2 to 7. It is preferable that the shape of the metal particle is needle shape.

In the present embodiment, the CV value of the aspect ratios of the metal particles is 0.40 or less. CV shows the coefficient of variation and can be obtained from the following equation:

$$\text{Coefficient of variation(CV)} = \text{standard deviation value/average value}$$

The CV value of the aspect ratios of the metal particles is 0.40 or less, allowing to suppress variation in demagnetizing field coefficient. The resonance frequency is proportional to the difference of the demagnetizing field coefficient (minor axis-major axis), and as a result, it is possible to suppress variation in the resonance frequency and narrow the line width of the resonance peak. Therefore, even when the use frequency of the composite magnetic body is increased to the vicinity of the resonance frequency, low magnetic loss can be maintained. From the same viewpoint, the CV value of the aspect ratios of the metal particles is preferably 0.35 or less, and more preferably 0.30 or less. The CV value of the aspect ratios of the metal particles can be 0.10 or more.

In the present embodiment, the average value of the major axis diameters of the metal particles (hereinafter sometimes referred to as an average major axis diameter) is 30 to 500 nm. The average major axis diameter of the metal particles is 30 nm or more, allowing to improve the filling property of the metal particles in the composite magnetic material and to provide high magnetic permeability. The average major axis diameter of the metal particles is 500 nm or less, not only allowing to provide the single magnetic domain state and to eliminate the loss of domain wall resonance, but also to suppress eddy current loss. From the same viewpoint, the average major axis diameter is preferably 40 to 350 nm, and more preferably 45 to 200 nm. The average minor axis diameter of the metal particles is, for example, about 5 to 50 nm, and can be 7 to 30 nm.

It is preferable that the metal particle includes the metal core portion and the metal oxide film coating the metal core portion. The metal core portion has conductivity, but the metal oxide film has insulating property. The metal particle has the metal oxide film, allowing to provide the insulating property between the metal particles and to reduce the magnetic loss caused by the generation of the eddy current between the particles.

In the metal particle, the metal core portion contains the above described element contained in the metal particle as a metal (zero valence), and has a magnetic portion containing Fe or Fe and Co as a main component. Since the metal core portion is coated with the metal oxide film, the metal core portion can exist without being oxidized even in the atmosphere. Therefore, high saturation magnetization, which Fe or Fe and Co has, can be easily obtained for the composite magnetic body. It is preferable that the metal core portion is an Fe—Co alloy in which Co is solid-soluted in Fe. The metal core portion is the Fe—Co alloy, improving the saturation magnetization of the metal particle and easily providing high magnetic permeability.

In the metal particle, the metal oxide film contains the above-described element included in the metal particle as an oxide. In the present embodiment, it is preferable that elements other than Fe and Co are contained in the metal oxide film. The elements other than Fe and Co are included in the metal oxide film, allowing to further improve the insulation property between the metal particles without lowering the magnetic property and to further reduce the magnetic loss caused by the generation of the eddy current.

The thickness of the metal oxide film can be, for example, 1 to 20 nm. The thickness of the metal oxide film is 1 nm or more, easily providing the insulating property between the metal particles and the effect of reducing the magnetic loss. The thickness of the metal oxide film is 20 nm or less, easily suppressing reduction of the magnetic property. From the same viewpoint, the thickness of the metal oxide film may be 1.5 to 15 nm, or may be 2.0 to 10 nm.

In the present embodiment, the volume ratio of the metal particles in the composite magnetic body is, for example, 20 to 60 volume %. The volume ratio of the metal particles is 20 volume % or more, easily providing desired magnetic characteristics. The volume ratio of the metal particles is 60 volume % or less, facilitating handling in processing. From the same viewpoint, it is preferable that the volume ratio is 30 to 60 volume %.

(Resin)

The resin is a resin (insulating resin) having electrical insulating property and is a material which is between the metal particles in the composite magnetic body, binds the metal particles, and further can improve the insulating property between the metal particles. Examples of the insulating resin include a silicone resin, a phenol resin, an acrylic resin, an epoxy resin, and a cured product thereof. One of these resins may be used alone, or two or more of these resins may be used in combination.

The volume ratio of the resin in the composite magnetic body can be, for example, 25 to 65 volume %. The volume ratio of the resin is 25 volume % or more, easily providing the insulating property and the bonding strength between the metal particles. The volume ratio of the resin is 65 volume % or less, easily exerting the property of the metal particles in the composite magnetic body.

[Method for Producing Composite Magnetic Body]

The method for producing the composite magnetic body according to the present embodiment includes a step of producing the metal particles, a step of mixing the metal particles and the resin to obtain a slurry-like composite magnetic material, a step of molding the composite magnetic material, and a step of curing the molded body. The above described step of producing the metal particles includes a neutralization step, an oxidation step, a dehydration-annealing step, a heat treatment step, and a gradual oxidation step. The above described method for producing the metal particles may further include a coating step after the oxidation step and before the dehydration-annealing step. As an example, the method for producing the metal particles containing a combination of Fe and Co as a main component will be described in order.

(Neutralization Step)

In the neutralization step, the particle containing ferrous hydroxide ($Fe(OH)_2$) is obtained by neutralization. The particle further contains Co in the form of substituting a part of Fe of ferrous hydroxide, or in the form of hydroxide of Co independent on ferrous hydroxide. Raw materials of Fe and Co are prepared. An example of the raw material of Fe includes iron sulfate. An example of a raw material of Co includes cobalt sulfate. In the neutralization step, the above raw material is dissolved in water to prepare an acidic aqueous solution, and this solution is mixed with an alkali aqueous solution. The particle containing ferrous hydroxide is obtained by neutralizing the (acidic) aqueous solution of the raw material with an alkali aqueous solution to make the aqueous solution weakly acidic. The conditions of the neutralization step and the oxidation step described later are variously changed, allowing to control the growth of the particle in the oxidation step and the size and shape of the goethite particle to be obtained, and furthermore, the size and shape of the obtained metal particle. For example, in the neutralization step, increasing the metal ion concentration in the above described acidic aqueous solution can increase the size of the goethite particle. Increasing the neutralization ratio with the above described alkali aqueous solution can increase the aspect ratio of the metal particle, while the CV value of the aspect ratios can be reduced by not increasing the neutralization ratio too much. Increasing the amount of the metal ion to be subjected to the oxidation step after the neutralization step promotes particle growth in the oxidation step and can reduce the CV value of the aspect ratios. Therefore, for example, controlling the neutralization ratio with an alkali aqueous solution and the amount of the ion to be subjected to the oxidation step can control the aspect ratio of the goethite particle and the CV value thereof. Controlling the size and shape of the goethite particle allows to easily control the size and shape of the metal particle.

(Oxidation Step)

In the oxidation step, the particle containing ferrous hydroxide after the neutralization step is oxidized. That is, bubbling is carried out in the aqueous solution after the neutralization step to provide the aqueous solution with oxygen. In the aqueous solution, the particle containing ferrous hydroxide is oxidized and the particle is grown during the oxidation reaction, allowing to provide the goethite ($\alpha$-FeO (OH)) particle containing Co. A metal sulfate such as iron sulfate and cobalt sulfate may be added to the above described aqueous solution to be subjected to bubbling. This can increase the metal ion concentration in the aqueous solution before the oxidation step after the neutralization step, promoting the particle growth in the oxidation step, and easily suppressing the CV value of the aspect ratio to a low level. The compound having the element such as Al, R, Ti, Zr, and Hf can be added to the above described aqueous solution to be subjected to bubbling. R represents a rare earth element or Y. As a result, these elements are incorporated into the particle during the growth of the particle, and the goethite particle containing the above described element in addition to Co is obtained. The compound added to the aqueous solution may be, for example, a sulfate of the above described element. The obtained goethite particles are filtered, washed with ion exchanged water, and isolated by drying.

(Coating Step)

In the coating step, the nonmagnetic metal element is coated on the surface of the goethite particle containing Co obtained after the oxidation step. In the coating step, the goethite particle after the oxidation step is charged into an alcoholic solution of the alkoxide of nonmagnetic metal elements such as Mn, Al, R, Ti, Zr, Hf, Mg, Ca, Sr, Ba, and Si. R represents a rare earth element or Y. Stirring while gradually hydrolyzing the alkoxide allows to coat the above described nonmagnetic metal element on the surface of the goethite particle. In the coating step, a single element may be coated or a plurality of elements may be coated. In the case of coating a plurality of elements, a plurality of elements may be separately coated by repeating two or more steps, or a plurality of elements is simultaneously coated in one step. The goethite particles after coating is filtered, washed with an alcohol or the like, and isolated by drying. In the coating process, it is preferable that Al or R is coated. The thickness of the coating is controlled by the alkoxide concentration in the above described alcohol solution and is appropriately set to obtain a desired thickness of the oxidized metal film. The coating causes the goethite particle to contain the above described nonmagnetic metal element on its surface. In the coating step, the coating element is mainly contained in the metal oxide film of the metal particle.

(Dehydration-Annealing Step)

In the dehydration-annealing step, the goethite particle containing Co obtained as described above is heated under an oxidizing atmosphere. The heating causes the goethite particle to be dehydrated and oxidized to become a Co-containing hematite ($\alpha$-$Fe_2O_3$) particle. The heating temperature is, for example, 300 to 600° C. When the goethite particle contains the nonmagnetic metal element, the hematite particle containing Co and the nonmagnetic metal element can be obtained.

(Heat Treatment Step)

In the heat treatment step, the hematite particle containing Co obtained in the dehydration-annealing step is heated in a reducing atmosphere such as a hydrogen atmosphere. The heating temperature is, for example, 300 to 600° C. When the hematite particle contains other nonmagnetic metal elements such as Mn other than Fe and Co, the hematite particle may be heated under an oxidation-reduction atmosphere. The oxidation-reduction atmosphere means an atmosphere in which both an oxidation reaction and a reduction reaction can occur in the hematite particle containing Co, which is the object of heat treatment. The oxidation-reduction atmosphere can be obtained by, for example, sending an oxidation-reduction gas into a furnace for heat treatment. Examples of the oxidation-reduction gas include a mixed gas of carbon monoxide and carbon dioxide and a mixed gas of hydrogen and steam. When the hematite particle is heated under an oxidation-reduction atmosphere, only Fe and Co are reduced, and the other elements described above are discharged and concentrated on the surface of the particle as they are in the form of oxides. In the metal particle, the discharged-concentrated element can mainly constitute a metal oxide film. For this reason, it is easy to obtain the metal particles having high magnetic property and excellent insulating property, and eddy current loss is easily reduced.

After the heat treatment, the inside of the furnace is switched from the (oxidation) reduction gas to the inert gas, and is cooled to around 200° C.

(Gradual Oxidation Step)

In the gradual oxidation step, the oxygen partial pressure inside the furnace cooled to around 200° C. after the heat treatment step is gradually increased and gradually cooled to room temperature. As a result, the surface of the particle is gradually oxidized, and a metal oxide film containing an element existing on the particle surface before the heat treatment step and an element concentrated on the surface in the heat treatment step is formed. Examples of the element present on the particle surface before the heat treatment step include Fe, Co and other elements added in the neutralization step or the oxidation step and present on the surface of the goethite particle after the oxidation step, and the non-magnetic metal element coated on the surface of the particle in the coating step or the like.

As described above, the metal particles including the metal core portion and the metal oxide film coated on the metal core portion are obtained.

A slurry-like composite magnetic material is then prepared using the obtained metal particles.

(Mixing Step)

In the mixing step, the metal particles obtained as described above and, for example, a thermosetting resin, and a curing agent are mixed to obtain a composite magnetic material. The thermosetting resin and the curing agent may be in a liquid state or a solid state, and when the thermosetting resin or the like is solid, the thermosetting resin is mixed with an organic solvent. In this step, other components such as a dispersant and a coupling agent may be added. As a mixing method, for example, a stirrer/mixer such as a pressure kneader and a ball mill is selected. Mixing conditions are not particularly limited, but mixing is performed, for example, at room temperature for 20 to 60 minutes so that the metal particles can be dispersed in the resin. Examples of the organic solvent include acetone, methanol, and ethanol. As described above, the slurry-like composite magnetic material containing the metal particles, the thermosetting resin, and the curing agent is obtained. Instead of the thermosetting resin and the curing agent, a thermoplastic resin may also be used.

(Molding Step)

In the molding step, the composite magnetic material is heated, pressurized, and molded to obtain a molded body. The molding temperature is the resin softening point or more, and when the composite magnetic material contains a thermosetting resin and a curing agent, it is the heating temperature or less in the subsequent curing step. The molding temperature is, for example, 60 to 80° C. When an organic solvent is used in the mixing step, the composite magnetic material containing the organic solvent is applied and dried to obtain a dried body. The dried body is heated and pressurized and molded to obtain a molded body.

(The Curing Step)

In the curing step, the molded body is heated and cured to obtain a composite magnetic body. The heating temperature is appropriately selected depending on the type of the resin and the curing agent, and the heating temperature is higher than the molding temperature in the molding step and can be 120 to 200° C. The heating time can be 0.5 to 3 hours.

Note that, temporary curing may be performed before the above described curing. In the case of the temporary curing, the above described curing after the temporary curing may be referred to as main curing. The heating temperature for the temporary curing can be 60 to 120° C. The heating time can be 0.5 to 2 hours. The temporary curing can suppress extremely low viscosity of the resin at the main curing.

The temporary curing and the main curing may be carried out either in an air atmosphere, in an inert gas atmosphere, or in a vacuum, and in the inert gas atmosphere or in the vacuum is preferable in order to suppress oxidation of the metal particle.

As described above, the composite magnetic body including the metal particles and the resin is obtained. The composite magnetic body according to the present embodiment has high magnetic permeability and low magnetic loss in the high frequency band. Therefore, the composite magnetic body according to the present embodiment is useful for a constituent material of high frequency electronic components.

EXAMPLES

Hereinafter, the present invention will be described in more detail with reference to Examples, but the present invention is not limited to the following Examples.

[Preparation of Composite Magnetic Body]

Example 1

Aqueous solutions of ferrous sulfate and cobalt sulfate were blended so that Fe and Co in the metal particle had the mass ratio shown in the following Table 1, and these were partially neutralized with an alkali aqueous solution (the neutralization step). The aqueous solution after neutralization was bubbled for aeration, and the above described aqueous solution was stirred to obtain the needle-like goethite particles containing Co (the oxidation step). The goethite particles containing Co obtained by filtering the aqueous solution was washed with ion exchange water and dried, and further heated in air to obtain the hematite particles containing Co (the dehydration-annealing step).

The obtained Co-containing hematite particles were heated at a temperature of 550° C. in a furnace having a hydrogen atmosphere (heat treatment step). The atmosphere inside the furnace was switched to argon gas and cooled to about 200° C. While the oxygen partial pressure increased to 21% over 24 hours, it was cooled to room temperature to obtain the metallic particles that had a metal core portion and a metal oxide film and was mainly composed of Fe and Co (the gradual oxidation step). The evaluation results of the obtained metal particles are shown in Table 1.

The epoxy resin (trade name: JER 806 manufactured by Mitsubishi Chemical Corporation) and a curing agent were added to the obtained metal particles and kneaded at 95° C. using a mixing roll; kneading was continued while gradually cooling to 70° C.; kneading was stopped when the temperature reached 70° C. or less; and rapid cooling was performed to room temperature to obtain the slurry-like composite magnetic material in Example 1 (the mixing step). The obtained composite magnetic material was charged into a mold heated to 100° C., and molding was performed at a molding pressure of 980 MPa. The obtained molded body was thermally cured at 180° C., cut out to obtain a composite magnetic body. The shape of the composite magnetic body was a rectangular of 1 mm×1 mm×100 mm. The volume ratios of the metal particles in the solid content of the obtained composite magnetic material and in the composite magnetic body were 40 volume %. The preparation conditions of the composite magnetic body are summarized in Table 1.

Example 2

A composite magnetic body in Example 2 was obtained in the same manner as in Example 1 except that in the neutralization step, aqueous solutions of ferrous sulfate and cobalt sulfate were blended so that Fe and Co in the metal particle had the mass ratio shown in the following Table 1, and in the neutralization step, the neutralization ratio by the alkali aqueous solution was increased and the concentration of the metal (Fe and Co) ions after neutralization to be subjected to the oxidation step was increased to increase the average aspect ratio of the metal particles as shown in the following Table 1.

Example 3

A composite magnetic body in Example 3 was obtained in the same manner as in Example 1 except that in the neutralization step, aqueous solutions of ferrous sulfate and cobalt sulfate were blended so that Fe and Co in the metal particle had the mass ratio shown in the following Table 1, and in the neutralization step, the neutralization ratio by the alkali aqueous solution was increased and the concentration of the metal (Fe and Co) ions after neutralization to be subjected to the oxidation step was increased to increase the average aspect ratio of the metal particles as shown in the following Table 1.

Comparative Example 1

A composite magnetic body in Comparative Example 1 was obtained in the same manner as in Example 1 except that in the neutralization step, the neutralization ratio by the alkali aqueous solution was decreased to decrease the average aspect ratio of the metal particles as shown in the following Table 1.

Comparative Example 2

A composite magnetic body in Comparative Example 2 was obtained in the same manner as in Example 1 except that in the neutralization step, aqueous solutions of ferrous sulfate and cobalt sulfate were blended so that Fe and Co in the metal particle had the mass ratio shown in the following Table 1, and in the neutralization step, the neutralization ratio by the alkali aqueous solution was increased and the concentration of the metal (Fe and Co) ions after neutralization to be subjected to the oxidation step was increased to increase the average aspect ratio of the metal particles as shown in the following Table 1.

Example 4

A composite magnetic body in Example 4 was obtained in the same manner as in Example 2 except that in the neutralization step, the neutralization ratio by the alkali aqueous solution was increased and the concentration of the metal (Fe and Co) ions after neutralization to be subjected to the oxidation step was decreased to change the CV value of the aspect ratio of the metal particles as shown in the following Table 1.

Comparative Example 3

A composite magnetic body in Comparative Example 3 was obtained in the same manner as in Example 2 except that in the neutralization step, the neutralization ratio by the alkali aqueous solution was increased and the concentration of the metal (Fe and Co) ions after neutralization to be subjected to the oxidation step was decreased to increase the CV value of the aspect ratio of the metal particles as shown in the following Table 1.

Comparative Example 4

A composite magnetic body in Comparative Example 4 was obtained in the same manner as in Example 2 except that in the neutralization step, the concentration of the metal (Fe and Co) ions in the aqueous solution before neutralization was decreased to decrease the average major axis diameter of the metal particles as shown in the following Table 1.

Example 5

A composite magnetic body in Example 5 was obtained in the same manner as in Example 2 except that in the neutralization step, the concentration of the metal (Fe and Co) ions in the aqueous solution before neutralization was decreased to decrease the average major axis diameter of the metal particles as shown in the following Table 1.

Example 6

A composite magnetic body in Example 6 was obtained in the same manner as in Example 2 except that in the neutralization step, the concentration of the metal (Fe and Co) ions in the aqueous solution before neutralization was increased to increase the average major axis diameter of the metal particles as shown in the following Table 1.

Comparative Example 5

A composite magnetic body in Comparative Example 5 was obtained in the same manner as in Example 2 except that in the neutralization step, the concentration of the metal (Fe and Co) ions in the aqueous solution before neutralization was increased to increase the average major axis diameter of the metal particles as shown in the following Table 1.

Example 7

A composite magnetic body in Example 7 was obtained in the same manner as in Example 1 except that an aqueous solution of ferrous sulfate was used in place of aqueous solutions of ferrous sulfate and cobalt sulfate in the neutralization step, and in the neutralization step, the metal (Fe) ion concentration in the aqueous solution and the neutralization ratio by the alkali aqueous solution were changed to change the average aspect ratio and the CV value of the aspect ratio of the metal particles as shown in the following Table 1.

[Evaluation Method]

(Size, Aspect Ratio, and its CV Value of Metal Particle)

The bright field image of the metal particles obtained in Examples and Comparative Examples was observed with a transmission electron microscope (TEM) at a magnification of 500000, and the sizes of major axis and minor axis directions of the metal particle (major axis diameter and minor axis diameter) (nm) were measured to obtain the aspect ratio. Similarly, 200 to 500 metal particles were observed, and the average values of the major axis diameter, the minor axis diameter, and the aspect ratio were calculated. Further, with respect to the aspect ratio, its CV value (standard deviation value/average value) was obtained. Table 1 shows the evaluation results of the average major axis diameter, the average aspect ratio, and the CV value of the aspect ratio.

(Complex Permeability and Magnetic Loss)

The real part μ', imaginary part μ", and magnetic loss tan Q, of the complex permeability of the composite magnetic body obtained in Examples and Comparative Examples were measured by a perturbation method with a network analyzer (HP8753D manufactured by Agilent Technologies, Inc.) and a cavity resonator (manufactured by Kanto Electronic Applied Development Co., Ltd.) at a frequency of 2.4 GHz. The measurement results of μ' and tan $\delta_\mu$ are shown in Table 1.

TABLE 1

| | Fe/(Fe + Co) [mass %] | Magnetic powder | Average aspect ratio | CV value of aspect ratios | Average major axis diameter [nm] | Volume ratio of metal particles [volume %] | Magnetic property (2.4 GHz) μ' | Magnetic property (2.4 GHz) $\tan\delta_\mu$ |
|---|---|---|---|---|---|---|---|---|
| Comparative Example 1 | 88 | FeCo | 1.2 | 0.24 | 120 | 40 | 2.24 | 0.0195 |
| Example 1 | 88 | FeCo | 1.5 | 0.20 | 120 | 40 | 1.91 | 0.0077 |
| Example 2 | 71 | FeCo | 5.6 | 0.21 | 120 | 40 | 1.70 | 0.0041 |
| Example 3 | 71 | FeCo | 9.4 | 0.23 | 120 | 40 | 1.53 | 0.0025 |
| Comparative Example 2 | 71 | FeCo | 12.0 | 0.22 | 120 | 40 | 1.45 | 0.0018 |
| Example 4 | 71 | FeCo | 5.6 | 0.38 | 120 | 40 | 1.68 | 0.0077 |
| Comparative Example 3 | 71 | FeCo | 5.6 | 0.45 | 120 | 40 | 1.76 | 0.0276 |
| Comparative Example 4 | 71 | FeCo | 5.6 | 0.26 | 25 | 40 | 1.37 | 0.0018 |
| Example 5 | 71 | FeCo | 5.6 | 0.20 | 30 | 40 | 1.51 | 0.0027 |
| Example 6 | 71 | FeCo | 5.6 | 0.21 | 500 | 40 | 1.86 | 0.0085 |
| Comparative Example 5 | 71 | FeCo | 5.6 | 0.25 | 550 | 40 | 1.86 | 0.0122 |
| Example 7 | 100 | Fe | 5.6 | 0.27 | 120 | 40 | 1.51 | 0.0027 |

As was apparent from Table 1, it was confirmed that the composite magnetic bodies in Examples 1 to 7 had high magnetic permeability and low magnetic loss in the high frequency band.

What is claimed is:

1. A composite magnetic body comprising:

metal particles containing Fe or Fe and Co as a main component; and a resin, wherein an average major axis diameter of the metal particles is 30 to 500 nm, an average of the aspect ratios of the metal particles is 1.5 to 10, a CV value of the aspect ratios is 0.40 or less, and the metal particle comprises a metal core portion and a metal oxide film coating the metal core portion.

2. A high frequency electronic component comprising the composite magnetic body according to claim 1.

* * * * *